United States Patent [19]

Matsuo et al.

[11] Patent Number: 4,836,863

[45] Date of Patent: Jun. 6, 1989

[54] WROUGHT MATERIAL OF ALUMINUM ALLOY TO BE ANODIZED GRAY AND PROCESS FOR MAKING THE SAME

[75] Inventors: Mamoru Matsuo; Masami Furuya, both of Fukaya, Japan

[73] Assignee: Sky Aluminum Co., Ltd., Japan

[21] Appl. No.: 122,290

[22] Filed: Nov. 18, 1987

[30] Foreign Application Priority Data

Nov. 20, 1986 [JP] Japan ..... 61-277723

[51] Int. Cl.[4] ..... C22F 1/04

[52] U.S. Cl. ..... 148/2; 148/11.5 A; 148/440

[58] Field of Search ..... 148/440, 2, 11.5 A; 420/544, 546

[56] References Cited

U.S. PATENT DOCUMENTS 3,397,044 8/1968 Bylund ..... 420/546

OTHER PUBLICATIONS

Chemical Abstracts, 88(4): 29434x.

*Primary Examiner*—R. Dean

*Attorney, Agent, or Firm*—Oliff & Berridge

[57] ABSTRACT

Herein disclosed are the ingredient and composition of a wrought material of an aluminum alloy to be anodized into a dense gray color for facing buildings, and a process for making the wrought aluminum alloy material. This material consists essentially of 0.4 to 1.0% of Fe, 0.05 to 0.25% of Si, 0.3 to 1.5% of Mg, 0.05 to 0.7% of Mn (<Fe in percentage), 0.10% or less of Ti, and 0.003% of B, if necessary, in weight ratio, the remainder being Al and irreversible impurities. According to the process for making the wrought material, an alloy having the above-specified ingredient and composition is direct chill cast, and the cast ingot is heated at 350° to 580° C. for 0.5 to 12 hours and is then hot worked.

7 Claims, No Drawings

WROUGHT MATERIAL OF ALUMINUM ALLOY TO BE ANODIZED GRAY AND PROCESS FOR MAKING THE SAME

BACKGROUND OF THE INVENTION

The present invention relates to a wrought material of an aluminum alloy to be anodized for facing structures such as buildings and a process for making the same and, more particularly, to a wrought material of an aluminum alloy to be anodized into the so-called "dense gray", i.e., a gray or dark gray color and a process for making the same.

Generally speaking, major aluminum alloys to be anodized for facing buildings or the like in the prior art are alloys JIS (which is the abbreviation of "Japanese Industrial Standards") Nos. 1100, 1050 and 5005, which have colors represented by a light gray through an anodization in a sulfuric acid bath, by a brown through a natural coloring anodization or through a coloring by the so-called "Asada method". In recent years, however, from the standpoint of seeking for apparent depth of buildings, there is an intense demand for an aluminum alloy assuming a color of the dense gray, i.e., a gray or dark gray after the anodization.

As the building aluminum alloy materials assuming the aforementioned gray or dark gray color after the anodization, there has been partially used in Al-Si alloy JIS No. 4343 or its improved alloy.

However, this Al-Si alloy JIS No. 4343 or its improved alloy can assume a color of dense gray after the anodization but is susceptible to the influence of heat. As a result. The color is liable to fluctuate not only among the production lots but also in one lot. This makes it extremely difficult to produce an alloy plate which can stably assume the dense gray in an identical tone. On the other hand, the Al-Si alloy is defective in that it has a lower anticorrosion after the anodization than those of the above-specified alloys JIS Nos. 1100 and 5005. This raises another problem as the aluminum alloy to be used for facing the buildings.

Incidentally, it is known that a pattern called the "fir-tree structure" frequently appears in the section of an alloy ingot which will separate an intermetallic compound of Al-Fe, such as the alloy JIS No. 1100, 1050 or 5005. In this fir-tree structure, the ingot has its internal region assuming a relatively dark gray and its external region near the surface assuming a relatively light gray in its section when it is anodized. Thus, the fir-tree structure is named so because the boundary between the darker gray portion (i.e., the internal region) and the lighter gray portion (i.e., the external region) appears as it were a fir-tree in the longitudinal section of the ingot. It is also known that the fir-tree structure is caused by the difference in the kinds of crystallizing Al-Fe compounds depending upon the portions of the ingot. Roughly speaking, crystallizing in the ingot the intermetallic compounds $Al_mFe$, $Al_3Fe$ and $Al_6Fe$, which have such different electrochemical properties that the phases of $Al_mFe$ and $Al_3Fe$ are oxidized during the anodization to exist as oxides in the oxidized film whereas the phase of $Al_6Fe$ is not oxidized to exist as the metallic phase in the film. This $Al_6Fe$ phase left unoxidized, if any in the film, will absorb an incident light to assume a darker gray than the other $Al_3Fe$ and $Al_mFe$ phases. Generally speaking, the $Al_mFe$ phase is present mainly in the external region of the fir-tree structure whereas the $Al_6Fe$ and $Al_3Fe$ are present in the internal region so that this internal region containing the $Al_6Fe$ phase exhibits a darker gray than the external region composed mainly of the $Al_mFe$ phases, as is known in the art.

It is, therefore, conceivable to make an aluminum alloy sheet which can assume a dense gray, i.e., a gray or dark gray, after anodized, even if it is not made of the aforementioned Al-Si alloy, if the internal region of the fir-tree structure is so enlarged as to construct the ingot in its entirely of the structure of the internal region of the fir-tree structure thereby to make an ingot substantially having no fir-tree structure.

In Japanese Patent Publication No. 58 - 26431, on the other hand, we have already proposed a composition for enlarging the internal region of the fir-tree structure of aluminum alloys of Al-Fe-Si-Mg to make a structure wholly of the internal region. According to the invention proposed, it is possible to make an alloy sheet which is anodized into a color of the gray or dark gray, and this alloy can enjoy more excellent anticorrosion than the aforementioned Al-Si alloy. Despite this possibility, however, the fact is that the color of the gray or dark gray is not always stabilized if the whole ingot is constructed of the structure of the internal region of the fir-tree structure according to that proposal. Since, not only the $Al_6Fe$ phase assumes the dark gray but also the $Al_3Fe$ phase will crystallize into the internal region of the fir-tree structure, as has been described hereinbefore, even the structure of the internal region will cause a change in the gray tone if the ratio between the $Al_6Fe$ and $Al_3Fe$ phases changes. This color may sometimes fluctuate depending especially upon the casting and hot working conditions.

We therefore have repeated experiments and researches so as to develop both an aluminum alloy of Al-Fe-Si-Mg, which can be stably anodized to assume an identical color of gray or dark gray, and a process for making the same. As a result, it is found, as has already been proposed in Japanese Patent Laid-Open No. 61 - 110741 (corresponding to Japanese Patent Application No. 59 - 231849) that it is necessary for stably assuming a constant color of gray or dark gray to have the $Al_6Fe$ phase occupy 70% or more of the total intermetallic compound of Al-Fe in the portion of the cast ingot, which will finally form the surface of a rolled sheet, i.e., the (skin) portion of 50 mm depth from the surface of the ingot, by strictly regulating the ratio of Fe and Si in relation to Mg and by properly setting the ingot casting conditions.

According to the above-specified proposal of Japanese Patent Laid-Open No. 61 - 110741, the $Al_6Fe$ phase can crystallize relatively stably to considerably stabilize the gray or dark gray color. It is, however found, in the case of the composition of the Al-Fe-Si-Mg proposed, that the mixing ratio of the two $Al_6Fe$ and $Al_3Fe$ phases will still fluctuate depending upon the casting conditions so that the anodized color will fluctuate in the lot and among the lots of the final rolled sheets.

SUMMARY OF THE INVENTION

The present invention has been conceived in view of the background thus far described and has an object to provide a wrought material of an aluminum alloy, in which the $Al_6Fe$ phase is more stably crystallized to better stabilize the anodized gray or dark gray of a final rolled sheet, and a process for making the wrought material.

Thinking that the $Al_6Fe$ phase of the intermetallic compounds in the Al-Fe(-Mg-Si) alloy is metastable and is stabilized to effect stable crystallization of the $Al_6Fe$ phase, we have examined the component, in which the stable phase of an intermetallic compound between Al and another metal M has a structure of $Al_6M$. As a result, we have found that Mn generates a stable $Al_6Mn$ phase and that the $Al_6$ Mn phase is effective for stabilizing the $Al_6Fe$ phase. More specifically, the present invention has been conceived by finding that the Mn added to the Al-Fe-Mg-Si system will migrate into the $Al_6Fe$ phase to form the $Al_6Fe(Mn)$ phase, in which the Fe of the $Al_6$ Fe phase is partially replaced by the Mn, and that the $Al_6Fe(Mn)$ phase is far more stable than the pure $Al_6Fe$ phase to effectively stabilize the anodized gray or dark gray of the final rolled sheet.

By adding a proper amount of Mn to the Al-Fe-Mg-Si system, as described above, it is still possible to stably obtain the anodized gray or dark gray of the final rolled sheet, by having 70% or more of $Al_6Fe(Mn)$ phase contained in the total amount of the intermetallic compounds of the ingot, even if the restrictions of the Fe/Si ratio and the casting conditions on the proposal of Japanese Patent Laid-Open No. 61 - 110741 are released.

More specifically, a wrought material of an aluminum alloy according to the present invention consists essentially of 0.4 to 1.0% of Fe, 0.05 to 0.25% of Si, 0.3 to 1.5% or Mg, 0.05 to 0.7% of Mn, 0.10% or less of Ti, and 0.0003 to 0.03% of B, if necessary, in weight ratio, the remainder being A and unavoidable impurities.

On the other hand, a process for making a wrought material of an aluminum alloy according to the present invention comprises the steps of: direct chill casting an aluminum alloy consisting essentially of 0.4 to 1.0 % of Fe, 0.05 to 0.25% of Si, 0.3 to 1.5% of Mg, 0.05 to 0.7% of Mn, 0.10% or less of Ti, and 0.0003 to 0.03% of B, if necessary, in weight ratio, the remainder being Al and unavoidable impurities; heating the cast ingot at a temperature ranging from 350° to 580° C. for 0.5 to 12 hours; and hot working the heated ingot at a temperature equal to or lower than the temperature range.

DETAILED DESCRIPTION OF THE INVENTION

First of all, the reasons why restrictions are exerted upon the alloy composition of the present invention will be described in the following. Fe (Iron):

If the content of Fe is less than 0.4%, the amount of the $Al_6Fe(Mn)$ contributing to assumption of the dense gray after the anodization is reduced to make the gray color denser. On the contrary, the content of Fe exceeding 1.0% will deteriorate the anticorrosion of the alloy. Hence, the range of the Fe content is set within 0.4 to 1.0%. Si (Silicon):

For the content of Si less than 0.05%, a highly pure Al metal is uneconomically required. On the contrary, the alloy containing more than 0.25% of Si will be anodized into a total color of yellow, which falls outside of the achromatic color of the target dense gray of the present invention. Hence, the Si content is set within the range of 0.05 to 0.25%. Mg (Magnesium):

This component has an effect to prevent the rolled sheet from any streaky defect due to formation of recrystallized coarse grains. In order to anodize the alloy into the dense gray by the $Al_6Fe(Mn)$ phase, the present invention is required to heat the ingot at a relatively low temperature of 580 C. or less prior to its hot working. In this case, the recrystallized coarse grains are liable to be formed during the hot working and rolled into the final rolled sheet, which is coarsely streaked to cause a defect after the anodization. Especially in the case of the alloy containing the Mn according to the present invention, a low ingot heating temperature will accelerate the coarse recrystallization to make it difficult to prevent the streaky defect. The Mg content is effective to prevent this streaky defect and is an indispensable element component for the alloy of the present invention. The Mg content cannot sufficiently attain that effect, if its content is less than 0.3%, and is liable to have a bad appearance due to the streaky defect. For the Mg content exceeding 1.5%, on the contrary, a Mg-Si crystal is formed to make the anodized gray color instable. Hence, the Mg content is set within the range of 0.3 to 1.5%.

Mn (Manganese):

This element is necessary for stabilizing the mestastable $Al_6Fe$ phase as the $Al_6Fe(Mn)$ phase. This $Al_6$-Fe(Mn) phase stabilized as a result of the Mn addition is also so stable against the heat that it is reluctant to experience the transformation of $Al_6Fe(Mn)$ - $Al_3Fe(Mn)$ even if it is heated. Thus, the $Al_6Fe(Mn)$ phase is featured by the fact that its color is reluctant to change even if the heating conditions fluctuate. If the Mn content is less than 0.05%, there can be attained little effect for stabilizing the $Al_6Fe$ phase. For the Mn content exceeding 0.7%, on the contrary, the anodization will make a reddish color, which undesirably goes to the outside of the target achromatic gray to dark gray. Hence, the Mn content is set within the range of 0.05 to 0.7%. Incidentally, for sufficient stabilization of the $Al_6Fe$ phase, the Mn content is preferred to exceed 0.2%. It is noted here that the Mn content in percentage is preferred to be less than the Fe content in percentage, because the Al $_6$Mn phase will begin to crystallize in addition to the $Al_6Fe(Mn)$ phase to make the reddish color if the Mn content exceeds the Fe content.

Ti (Titanium):

This element is added for refining the crystal grains of the ingot. If the Ti content exceeds 0.10%, however, a crystal of $Al_3Ti$ is formed to cause a linearity defect called the "stringer". Hence, the Ti content is set no more than 0.10%.

B (Boron):

This element is effective, if added together with Ti, for promoting the refining effect of the crystal grains of Ti so that it is added, if necessary, in the present invention. This addition exceeding 0.03% is liable to cause the linearity defect or the stringer to deteriorate the appearance. Hence, the upper limit of the B addition is set at 0.03%. Incidentally, the effect of the B in the presence of the Ti cannot be attained if the addition is less than 0.0003%. Therefore, no less than 0.0003% of B has to be added, if necessary.

In addition to the above-specified individual elements, the alloy may contain other elements such as Cu (copper), Zr (zirconium) or Cr (chromium) as unavoidable impurities, which is deriably regulated to be no more than 0.10% in total.

Next, the process for making the alloy of the present invention, i.e., the process according to the second mode of the present invention, will be described in the following in connection with the conditions of its individual steps.

At first, the alloy having the above-specified ingredient and component is cast, as usual, by the direct chill casting method (which is abbreviated into the DC casting method). Prior to a hot working, the cast ingot is heated at a temperature ranging from 350 to 580° C. for 0.5 to 12 hours. A heating temperature lower than 350° C. is not sufficient for the homogenization effect to allow coarse recrystallization to occur during the hot working to streak the product sheet. At a temperature exceeding 580° C., on the contrary, the transformation of the ingot proceeds, when heated, from the $Al_6$-Fe(Mn) to the $Al_3Fe(Mn)$ phase, even if the ingot is composed of the $Al_6Fe(Mn)$ phase on the the casting stage, until the $Al_6F(Mn)$ phase on the surface of the final rolled sheet becomes short to turn the anodized color lighter. For a holding time period shorter than 0.5 hours, on the other hand, the whole ingot fails to acquire a uniform temperature. On the contrary, the heating step longer than 12 hours is economically disadvantageous. Hence, the temperature and period for heating the ingot are determined, as specified above.

It is sufficient that the hot rolling be performed at the ingot heating temperature or lower by the conventional procedure and that the subsequent cold rolling be performed by the conventional procedure.

Incidentally, it is quite natural that the process of the present invention could be applied to the process for making not only the rolled material but also an extruded material. In case this extruded material is to be made, the process therefor may adopt the aforementioned heating temperature before the hot rolling and the aforementioned time period before the hot extrusion.

EXAMPLES

The alloys Nos. 1 to 5 having the chemical components enumerated in Table 1 were melted by the conventional procedure and cast by the direct chill casting method at a temperature of 700° C. and at a rate of 65 mm/min to prepare an ingot having a sectional size of 400 mm×1,000 mm.

The examinations of the sectional structures of the ingots of the alloys Nos. 1 to 5 have revealed that all the alloys Nos. 1 to 5 have revealed that all the alloys have their sections formed of the internal regions of the fir-tree structure.

Moreover, the individual ingots of the alloys Nos. 1 to 5 were then subjected to a homogenizing treatment of 480° C.×10 hours or 530 ° C.×10 hours and hot-rolled at a temperature of 430° C. so that they were finished into hot rolled sheets of 6 mm. These sheets were then cold rolled to have a thickness of 3 mm and were intermediately annealed under the condition of 350° C.×2 hours. These annealed sheets were finally cold rolled and finished into cold rolled sheets having a thickness of 2.0 mm. These sheets were caustically etched to have an etching depth of 20 μm and anodized with $H_2SO_4$ (15%) of 20° C. at a current density of 1.5 A/dm$^2$ to form anodized films having a thickness of 20 μm.

The colors of the surfaces after the anodizations were evaluated in terms of the L value of a Hunter color system by the use of the color meter SM-3-MCH which is produced by Suga Tester Co., Ltd. Also evaluated were the fluctuations of the L values in an identical lot and the streaks of the surfaces. These evaluated results are additionally enumerated in Table 2. In view of Table 2, it is found that the L values are lower for the denser gray color. Specifically, the L values equal to or lower than 70 are required as a target of the present invention for the gray to dark gray color. On the other hand, the fluctuations of the L values in one lot were evaluated and are indicated: at circle marks if their width in the lot was 1.0 or less; at triangle marks if the width was 1.0 to 2.0; and at X marks if the width exceeds 2.0. Moreover, the evaluations of the streaky defects were also made and are tabulated at X marks for NO GOOD and at circle marks for GOOD.

TABLE 1

| | | Chemical Components (wt. %) | | | | | | |
|---|---|---|---|---|---|---|---|---|
| Alloys | No | Fe | Si | Mg | Mn | Ti | B | Al |
| Invention | 1 | 0.65 | 0.08 | 0.55 | 0.15 | 0.01 | 0.0005 | Remainder |
| Invention | 2 | 0.75 | 0.10 | 1.00 | 0.50 | 0.01 | 0.0005 | Remainder |
| Invention | 3 | 0.75 | 0.09 | 0.99 | 0.48 | 0.01 | — | Remainder |
| Comparison | 4 | 0.55 | 0.10 | Tr | 0.25 | 0.01 | 0.0005 | Remainder |
| Comparison | 5 | 0.72 | 0.08 | 0.60 | Tr | 0.01 | 0.0004 | Remainder |

TABLE 2

| | | Homogen. | Anodized Surface | | |
|---|---|---|---|---|---|
| Alloys | No. | Temp. | L Values | Fluctuations | Streaks |
| Invention | 1 | 480 ° C. | 65 | o | o |
| | | 530 ° C. | 68 | o | o |
| Invention | 2 | 480 ° C. | 62 | o | o |
| | | 530 ° C. | 63 | o | o |
| Invention | 3 | 480 ° C. | 62 | o | o |
| | | 530 ° C | 63 | o | o |
| Comparison | 4 | 480 ° C. | 61 | o | X |
| | | 530 ° C. | 65 | o | X |
| Comparison | 5 | 480° C. | 69 | — | o |
| | | 530° C. | 73 | — | 0 |

As is apparent from Table 2, the alloys Nos. 1 to 3 of the present invention had no streak on the anodized surfaces and could make the gray to dark gray color remarkably stably.

Incidentally, the alloy No. 4 for comparison had no Mg added and experienced the streaky defect. On the other hand, the alloy No. 5 having no Mn added made more or less fluctuations in the color in the identical lot.

As is now apparent from the description thus far made, the wrought aluminum alloy material of the present invention can establish the so-called dense gray color of gray to dark gray remarkably stably as the anodized color without any of the streaky defect so that it can be most properly used for facing buildings required to have deep appearances. According to the making process of the present invention, moreover, the wrought material having the dense gray color of gray to dark gray but none of the defects such as streaks, as has been described above, can be made reliably and stably with neither any difficulty nor any strict restriction upon the casting conditions.

What is claimed is:

1. A wrought material of an aluminum alloy to be anodized gray or dark gray, consisting essentially of 0.4 to 1.0 wt % Fe, 0.05 to 0.25 wt % Si, 0.3 to 1.5 wt % Mg, 0.05 to 0.7 wt % Mn, and 0.10 wt % or less Ti, the remainder being Al and unavoidable impurities, said wrought material having a total amount of intermetallic compounds which contains at least 70% of an $Al_6$-Fe(Mn) phase, such that said wrought material effectively maintains a substantially uniform anodized gray or dark gray color.

2. A wrought aluminum alloy material according to claim 1, wherein Mn is present in an amount greater than 0.2 wt % and not greater than 0.7 wt %.

3. A wrought material of an aluminum alloy to be anodized gray or dark gray, consisting essentially of 0.4 to 1.0 wt % Fe, 0.05 to 0.25 wt % Si, 0.3 to 1.5 wt % Mg, 0.05 to 0.7 wt % of Mn, 0.10 wt % or less Ti, and 0.0003 to 0.03 wt % B, the remainder being Al and unavoidable impurities, said wrought material having a total amount of intermetallic compounds which contains at least 70% of an $Al_6Fe(Mn)$ phase, such that said wrought material effectively maintains a substantially uniform anodized gray or dark gray color.

4. A wrought aluminum alloy material according to claim 3, wherein the content of the Mn is present in an amount greater than 0.2 wt % and not greater than 0.7 wt %.

5. A process for making a wrought material of an aluminum alloy to be anodized gray or dark gray, comprising the steps: direct chill casting an aluminum alloy consisting essentially of 0.4 to 1.0 wt % Fe, 0.05 to 0.25 wt % Si, 0.3 to 1.5 wt % Mg, 0.05 to 0.7 wt % Mn, 0.10 wt % or less Ti, and 0.0003 to 0.03 wt % B, if necessary, the remainder being Al and unavoidable impurities; heating the cast ingot at a temperature ranging from 350 to 580° C. for 0.5 to 12 hours; and hot working the heated ingot at a temperature equal to or lower than the heating temperature range, wherein the resultant ingot has a total amount of intermetallic compounds which contains at least 70% of an $Al_6Fe(Mn)$ phase, such that the resultant ingot is capable of maintaining a substantially uniform anodized gray or dark gray color.

6. A wrought aluminum alloy material according to claim 1, wherein the percentage of Mn present in the alloy is less than the percentage of Fe present in the alloy.

7. A wrought aluminum alloy material according to claim 3, wherein the percentage of Mn present in the alloy is less than the percentage of Fe present in the alloy.

* * * * *